US008230932B2

(12) United States Patent
Ratcliffe et al.

(10) Patent No.: US 8,230,932 B2
(45) Date of Patent: Jul. 31, 2012

(54) MULTIFUNCTION DOWNHOLE RELEASE TOOL MECHANISM WITH LOST MOTION

(75) Inventors: James David Ratcliffe, Farnborough (GB); Timothy Gill, Farnborough (GB); Peter Withers, Farnborough (GB); Lee Strobel, Farnborough (GB); Graham Chadwick, Farnborough (GB)

(73) Assignee: Sondex Wireline Limited, Farnborough, Hampshire (GB)

( * ) Notice: Subject to any disclaimer, the term of this patent is extended or adjusted under 35 U.S.C. 154(b) by 64 days.

(21) Appl. No.: 12/956,294

(22) Filed: Nov. 30, 2010

(65) Prior Publication Data

US 2012/0132439 A1 May 31, 2012

(51) Int. Cl.
*E21B 23/14* (2006.01)
*E21B 23/00* (2006.01)

(52) U.S. Cl. ..... 166/377; 166/301
(58) Field of Classification Search ..... 166/301, 166/377
See application file for complete search history.

(56) References Cited

U.S. PATENT DOCUMENTS 3,045,081 A * 7/1962 Hanes ..... 200/61.53

* cited by examiner

*Primary Examiner* — Brad Harcourt
(74) *Attorney, Agent, or Firm* — Potomac Patent Group PLLC

(57) ABSTRACT

Presented is a system and method for disconnecting a plurality of wireline tools from a string of wireline tools while maintaining operation of the wireline tools remaining with the string of wireline tools. The disconnection is non-destructive and allows a reconnection of the disconnected tools after retrieval from the well. The system also enables testing of the disconnection mechanism before deploying the wireline tool string into the well.

20 Claims, 8 Drawing Sheets

RELEASE MECHANISM SHOWN IN CONNECTED POSITION

RELEASE MECHANISM SHOWN WITH LEADSCREW NUT HAVING TAKEN UP LOST MOTION

RELEASE MECHANISM SHOWN WITH FLOODING VALVE BEGINNING TO MOVE AND LATCHING DOGS PARTIALLY RELEASED

RELEASE MECHANISM SHOWN WITH FLOODING VALVE OPEN, LATCHING DOGS RELEASED AND RECIPROCATING SHAFT FORCED FULLY OPEN BY PRESSURE IN THE RELEASE CHAMBER NOTE THE FREE SPACE ON BOTH SIDES OF THE LEADSCREW NUT

RELEASE MECHANISM SHOWN FULLY RELEASED WITH FISHING NECK DISENGAGING

MULTIFUNCTION DOWNHOLE RELEASE TOOL MECHANISM WITH LOST MOTION

TECHNICAL FIELD

The present invention relates generally to down hole remotely operated oil well wireline tools and, more specifically, to a down hole wireline tool release mechanism.

BACKGROUND

The ever increasing use of fossil fuels has led to the development of drilling technologies that were unimaginable in the recent past. For instance, the ability to drill a well to a desired depth and then steer the well, with respect to the drilling platform, from a vertical direction to a horizontal direction is now a common practice. The direction of a well can be changed based on factors such as the geological strata or a recovery design plan for optimizing the output from the well.

The multidirectional drilling capabilities described above have introduced a new series of problems related to determining the operational parameters of the well. For example, a common task in the startup and operation of a well is to deploy one or more wireline tools down a well to collect data. The wireline tools can measure well parameters, employ cameras for optical observation or even perform radioactive irradiations to evaluate the localized geological strata. The key difference is in a well with a straight vertical direction and a well with an orientation that shifts from a vertical direction to a horizontal direction and possibly upwards towards the surface.

As is easily imagined, retrieving a series of wireline tools from a well with changing direction of bore is more difficult than retrieving the same series of wireline tools from a straight vertical well. For example, the force of gravity combined with the bend of a turn in the well can cause a string of wireline tools to become stuck. This problem can occur either because one of the tools is physically stuck in a bend in the well or the force required to pull the series of wireline tools through the bend is greater than the tensile strength of the wire attached to the wireline tools.

In another example, when perforating charges are detonated the perforation canister can deform during the explosion and become lodged in the well bore. As described above, the force required to retrieve the deformed perforation canister can exceed the tensile strength of the wire attached to the wireline tools.

Under the above described circumstances, a system and associated methods are desired allowing the release of the wireline tools above the obstruction without disrupting the ability of the remaining wireline tools to continue performing their intended tasks as the tool string is removed from the well. Additionally, the ability to reconnect wireline tools without requiring replacement of all components retrieved from the well is desirable because the additional benefit of the ability to test a string of wireline tools before insertion into the well becomes possible.

SUMMARY

Systems and methods according to the present invention address these needs by providing a multifunction down well release tool mechanism with a lost motion design and a flooding valve for disconnecting upper sections of the wireline tool string from lower sections of the tool string lodged in the well. After disconnection, the remainder of the wireline tool string, still attached to the wire, continues to function as the shortened string is removed from the well. The design also provides a nondestructive detachment allowing the wireline tool string to be reconnected with the remainder of the tool string removed from the well or to new elements of a tool string without replacing the elements of the tool string above the disconnect point.

According to an exemplary embodiment, a linear motion motor-driven reciprocating shaft actuates all aspects of the release process. These aspects include but are not limited to releasing the latching clamps, disconnecting the electrical connections passed to the subsequent tools in the string and actuating the flooding valve for pressure equalization of the release chamber.

According to another exemplary embodiment, a motor-driven rotating motion shaft rotates a cam mechanism that similarly actuates all aspects of the release process. As described above for the linear motion process, these aspects include but are not limited to releasing the latching clamps, disconnecting the electrical connections passed to the subsequent tools in the string and actuating the flooding valve for pressure equalization of the release chamber.

In various embodiments, the lost motion included in the actuation stroke protects the drive train from large pressure forces exerted by the well fluid when the tool is released. Accordingly, the design is robust and durable allowing for the reconnection of either new tools or disconnected tools recovered from the well.

BRIEF DESCRIPTION OF THE DRAWINGS

The accompanying drawings illustrate exemplary embodiments, wherein.

DETAILED DESCRIPTION

The following detailed description of the exemplary embodiments refers to the accompanying drawings. The same reference numbers in different drawings identify the same or similar elements. Also, the following detailed description does not limit the invention. Instead, the scope of the invention is defined by the appended claims.

Figure 1:
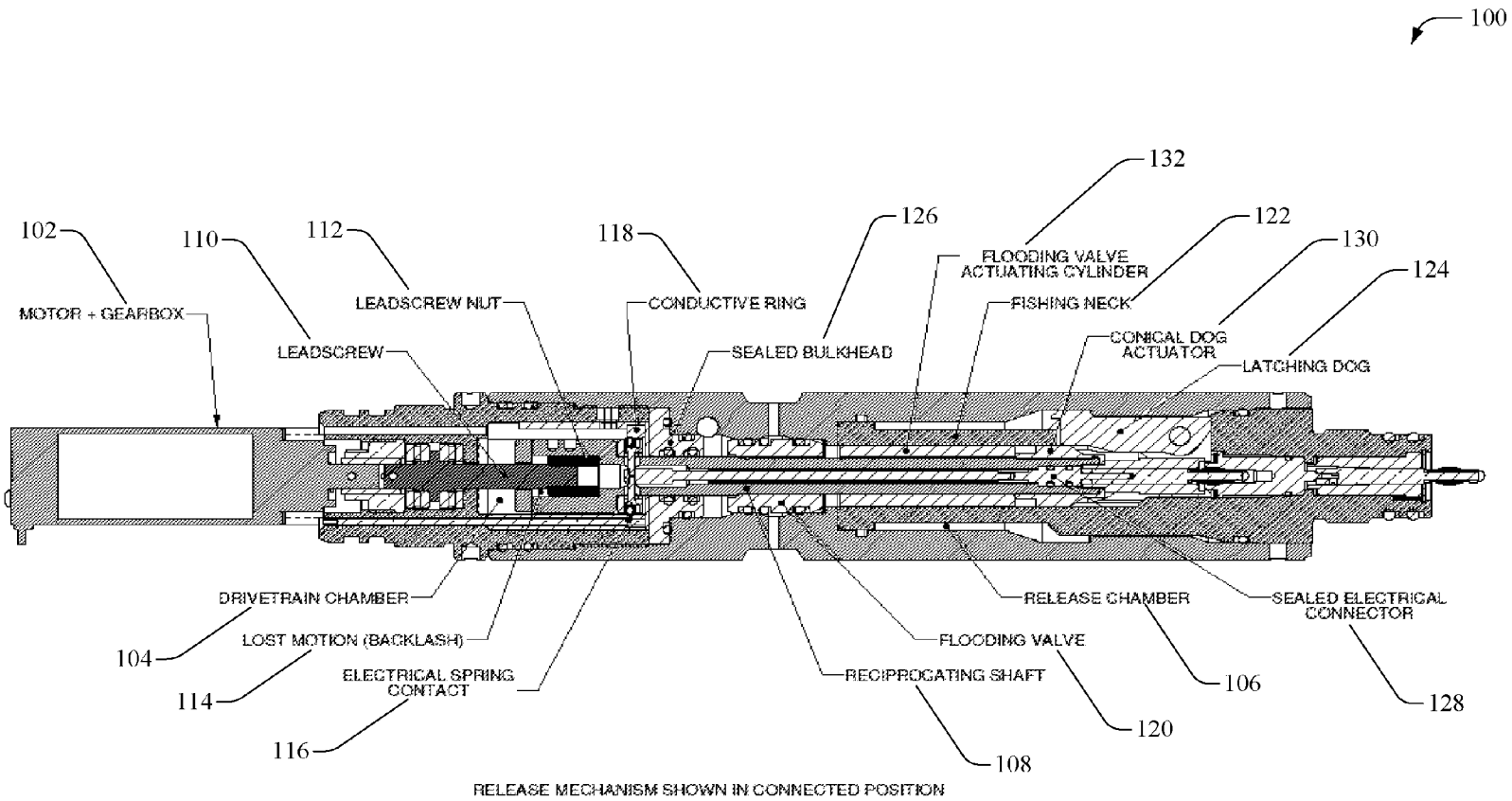
FIG. 1 depicts the release mechanism shown in the connected position, including the electric motor and the gearbox.

Looking first to FIG. 1, a detailed diagram of the release mechanism 100 according to an exemplary embodiment is illustrated. As discussed previously, the release mechanism 100 performs aspects of releasing one or more tools from the string of wireline tools. These aspects include, for example and not limited to, releasing the latching clamps 124, disconnecting the electrical connections passed to subsequent tools in the string 116/118 and actuating the flooding valve 120 for pressure equalization of the release chamber 106.

In general, a release mechanism is comprised of a motor/gearbox assembly 102, a drive train chamber 104 and its associated components, a release chamber 106 and its associated components, a flooding valve 120 separating the release chamber 106 from the outside well fluid, a sealed bulkhead 126 separating the drive train chamber 104 and the release chamber 106, and a reciprocating shaft 108. The reciprocating shaft 108 is functionally connected to the motor/gearbox assembly 102 through the leadscrew 110 and leadscrew nut 112 assemblies and simultaneously actuates, according to this exemplary embodiment, the electrical spring contact 116, the latching dogs 124 and the flooding valve 120.

The drive train chamber 104 houses the leadscrew 110 and the leadscrew nut 112 in an open area of lost motion 114 of the reciprocating shaft 108. The lost motion area 114 allows the reciprocating shaft 108 to strike the end of the drivetrain chamber 104 closest to the motor/gearbox 102 when the flooding valve 120 opens and the reciprocating shaft 108 is subjected to the full pressure of the well fluid. This protects the leadscrew 110 and the motor/gearbox 102 from damage.

In another aspect, the end of the drive train chamber 104 adjacent to the flooding valve 120 provides a conductive ring 118 around the perimeter of the drive train chamber 104. The conductive ring 118 provides power and data communications conductivity to the reciprocating shaft 108 for connection to additional wireline tools and release mechanisms 100 further along the wireline tool string. When the release mechanism is in the connected position, an electrical spring contact 116 engages with the conductive ring 118 providing a circuit for power and data communications connectivity. The electrical spring contact 116 is connected to the reciprocating shaft 108 and disconnects from the conductive ring 118 as the reciprocating shaft 108 begins to move towards the motor/gearbox 102.

A further aspect provides for a sealed bulkhead 126 that prevents well fluid from entering the drivetrain chamber 104 when the release mechanism 100 opens the flooding valve 120 and allows well fluid into the release chamber 106. Similarly, seals at the release end of the reciprocating shaft 108 located around the sealed electrical connector 128, prevent well fluid from entering the reciprocating shaft 108.

The release chamber 106 houses the fishing neck 122 and the latching dog 124 mechanism for retaining the fishing neck 122 in the release chamber 106 during connected operation. Only one latching dog 124 is shown in the section view of FIG. 1, However there is a plurality of latching dogs equal spaced around the axis of the tool. A conical latching dog actuator 130 is attached to the reciprocating shaft 108 and engages the latching dogs 124 when the reciprocating shaft 108 is in the connected position. When the reciprocating shaft 108 begins to move to the disconnected position, the conical latching dog actuator 130 is moved towards the flooding valve 120 and releases the latching dogs 124. Once the latching dogs 124 have released, the reciprocating shaft 108 continues to move towards the disconnected position and the flooding valve actuating cylinder 132 presses on the flooding valve 120, which causes it to move toward the sealing bulkhead 126. Once the o-ring seal at the end of the flooding valve 120 closest to the latching dogs 124 disengages from its sealing bore, well fluid flows into the release chamber 106, which equalizes the pressure in release chamber 106 with the ambient well pressure. Once well fluid has entered the release chamber 106, the pressure forces both the flooding valve 120 and reciprocating shaft 108 towards the motor/gearbox 102. Lost motion has been incorporated into both of these mechanisms so that, when they are subjected to well pressure, they are supported by suitably strong structural components. This protects the leadscrew 110, motor/gearbox 102 and other delicate actuating components from damage. With pressure equalized on the inside and the outside of the fishing neck 122, the release chamber 106 can easily be pulled from around the fishing neck 122 completing the disconnection.

The seals on the flooding valve 120 at the end closest to the drive train chamber 104 remain engaged to ensure that the flooding valve 120 is driven by well pressure into the fully open position, therefore accelerating the flooding process and also protecting the more delicate actuating components from damage.

In another aspect of release mechanism 100, an electric motor 102 rotates a leadscrew 110 through a high ratio gearbox 102. The leadscrew 110 drives a leadscrew nut 112 either up or down the axis of the reciprocating shaft 108. When the leadscrew nut 112 is driven away from the motor/gearbox 102 to the end of travel, the wireline tool attached to the fishing neck 122 is connected. When the leadscrew nut 112 is driven towards the motor/gearbox 102 to the end of travel, the wireline tool attached to the fishing neck 122 is released. Of course those skilled in the art will recognize that according to other, alternative exemplary embodiments it may be possible to reverse the relationship between the direction in which the leadscrew nut 112 is driven and the connected/released mode of the fishing neck 122.

The leadscrew nut 112 is captive within a contained area of the reciprocating shaft 108 but is not held rigidly according to this exemplary embodiment. The release mechanism design 100 includes free space on either side of the leadscrew nut 112 producing lost motion 114 or backlash in the actuating stroke. The reciprocating shaft 108 passes through a sealed bulkhead 126, which defines two different chambers within the release mechanism 100. The drive train chamber 104, on the motor/gearbox 102 side of the sealed bulkhead 126 is never entered by well fluid. The release chamber 106, on the other side of the sealed bulkhead 126 from the drive train chamber 104 becomes flooded with well fluid when a wireline tool disconnect is performed.

In the drive train chamber 104, the reciprocating shaft 108 is held within an insulated housing fitted with a conductive ring 118 at the end near the sealed bulkhead 126. When the reciprocating shaft 108 is in the connected position, the reciprocating shaft 108 is aligned such that an electrical spring contact 116 is in conductive contact with the conductive ring 118. This allows electrical power and data communications through the center of the reciprocating shaft 108 to the wireline tool attached to the fishing neck 122. When the reciprocating shaft 108 begins to move to the released position, the electrical spring contact 116 is pulled away from the conductive ring 118, thereby breaking the electrical and data communication connection to the exposed end of the reciprocating shaft 108 and the wireline tools connected to the fishing neck 122. This allows tools located above the release tool to continue operating after a tool disconnect is perform.

In the release chamber 106, the reciprocating shaft 108 passes through the center of a flooding valve 120 then enters through the top of a fishing neck 122 subassembly. At the other end of the fishing neck 122 subassembly are three latching dogs 124. The latching dogs 124 are used to hold the fishing neck 122 subassembly in the release chamber 106. The latching dogs 124 are driven into the latched position by the conical dog actuator 130 attached to the reciprocating shaft 108. When the reciprocating shaft 108 is in the connected position, the cone of the conical dog actuator 130 pushes outwards on the inside faces of the latching dogs 124, holding them locked into the release chamber 106 housing. As the reciprocating shaft 108 is moved to the released position, the conical dog actuator 130 is pulled out from under the inside faces of the latching dogs 124, allowing them to drop out of the locking sleeve in the release chamber 106 and releasing the fishing neck 122 subassembly from the release chamber 106.

In another aspect, loosely positioned around the reciprocating shaft 108 between the flooding valve 120 and the conical dog actuator 130 is the flooding valve actuating cylinder 132. As the reciprocating shaft 108 moves to the released position, the flooding valve actuating cylinder 132 becomes trapped between the conical dog actuator 130 and the flooding valve 120 and pushes the flooding valve towards the sealed bulkhead 126. Once the seal on the flooding valve 120 exits the seal bores in the release chamber 106 wall, well fluid is allowed to enter the release chamber 106. The flooding valve 120 also has lost motion on either side, allowing it to move rapidly to the flooding position as well fluid begins to enter the release chamber 106.

In another embodiment, the fishing neck 122 subassembly with its associated wireline tools is reconnected to the to the release mechanism 100 by manually pushing the fishing neck 122 subassembly into the release chamber 106. The motor/gearbox 102 is then run in the reverse direction from a disconnect operation. The leadscrew nut 112 first takes up the lost motion in the opposite direction. After the lost motion is recovered, the reciprocating shaft 108 is then pushed in the direction of the release chamber 106. The lost motion of the flooding valve 120 is now recovered and the flooding valve 120 is pushed to the closed position. As the reciprocating shaft 108 reaches the end of travel, the flooding valve 120 has completely closed, the conical dog actuator 130 forces the latching dogs 124 back into the locking sleeve in the release chamber 106 and the electrical spring contact 116 engages with the conductive ring 118 restoring power and data communications to wireline tools further along the wireline tool string. Although both the reciprocating shaft 108 and the flooding valve 120 experience lost motion while moving, both are driven to hard stops when in the connected position. This hard stop lockup prevents either from moving accidentally under the effects of shock or vibration.

Figure 2:
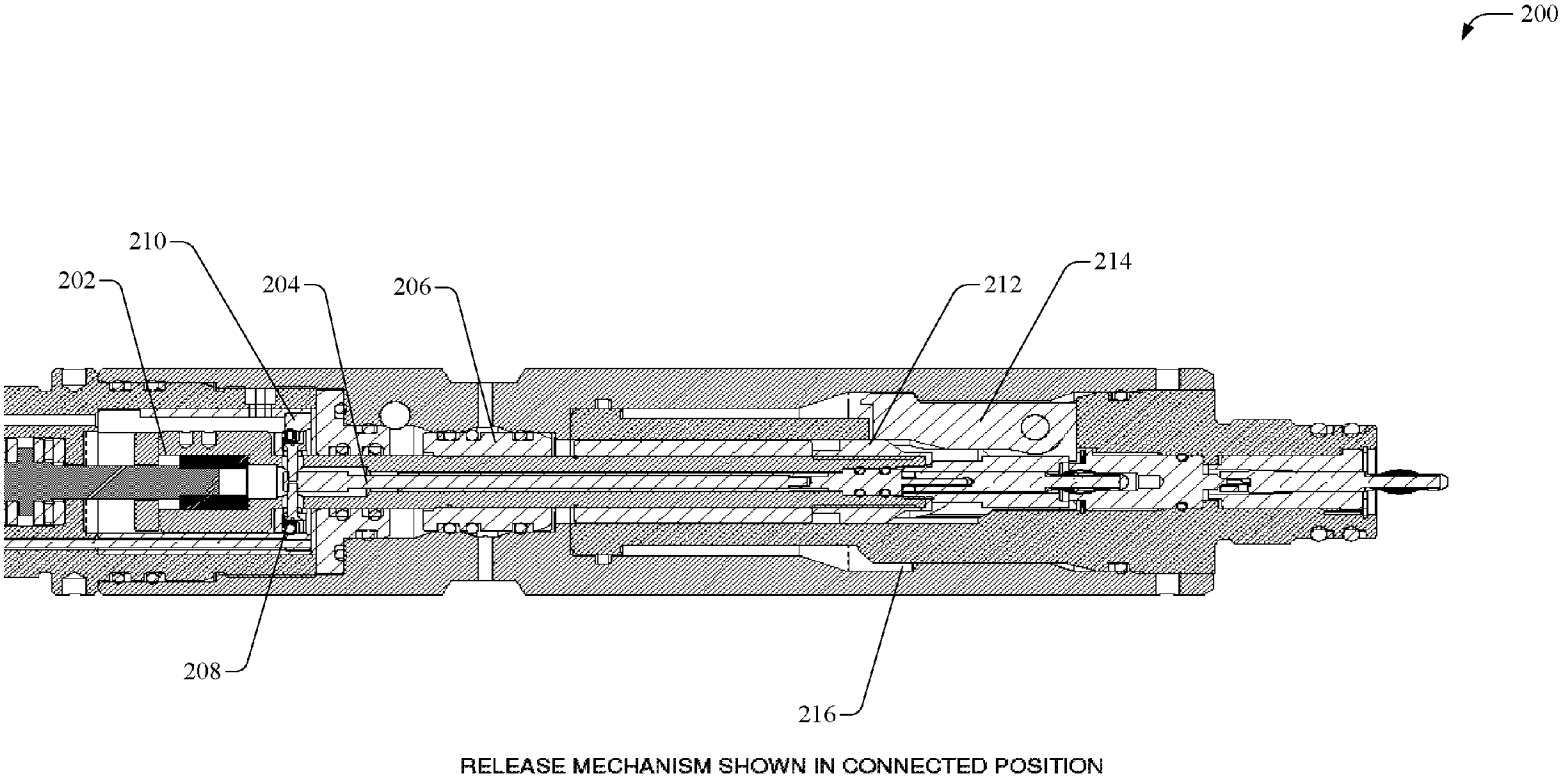
FIG. 2 depicts an enlarged view of the release mechanism drive train chamber and release chamber shown in the connected position.

Looking now to FIG. 2, an enlarged partial view of the release mechanism 100 is shown in the connected position. The leadscrew nut 202 is against the hard stop, locking the reciprocating shaft 204 in place to prevent any accidental disconnect from jarring or vibration. The electrical spring contact 208 is in contact with the conductive ring 210, therefore providing electrical power and data communication connectivity to any wireline tools attached to the fishing neck 122 subassembly. The flooding valve 206 is in the fully closed position and also resting against a hard stop to prevent accidental opening. Finally, the conical dog actuator 212 is engaged with the latching dogs 214 forcing them into a locked position in the locking sleeve 216 of the release chamber 106.

Figure 3:
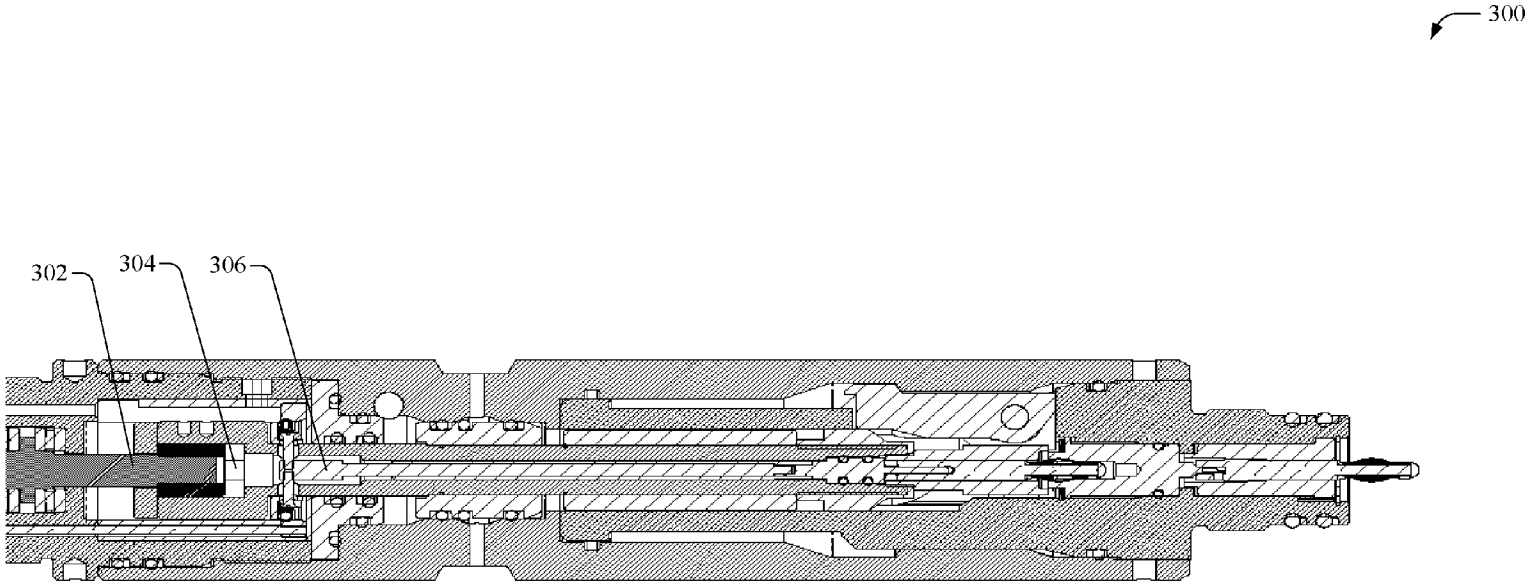
FIG. 3 depicts an enlarged view of the release mechanism drive train chamber and release chamber shown with the leadscrew nut advanced to take up lost motion.

FIG. 3 illustrates an enlarged partial view of the release mechanism 100 at the beginning of the disconnect cycle where the leadscrew 302 has rotated to the point where the leadscrew nut 304 has taken up all the lost motion in the reciprocating shaft 306. At this point, further rotation of the leadscrew 302 will result in movement of the reciprocating shaft in the disconnect direction.

Figure 4:
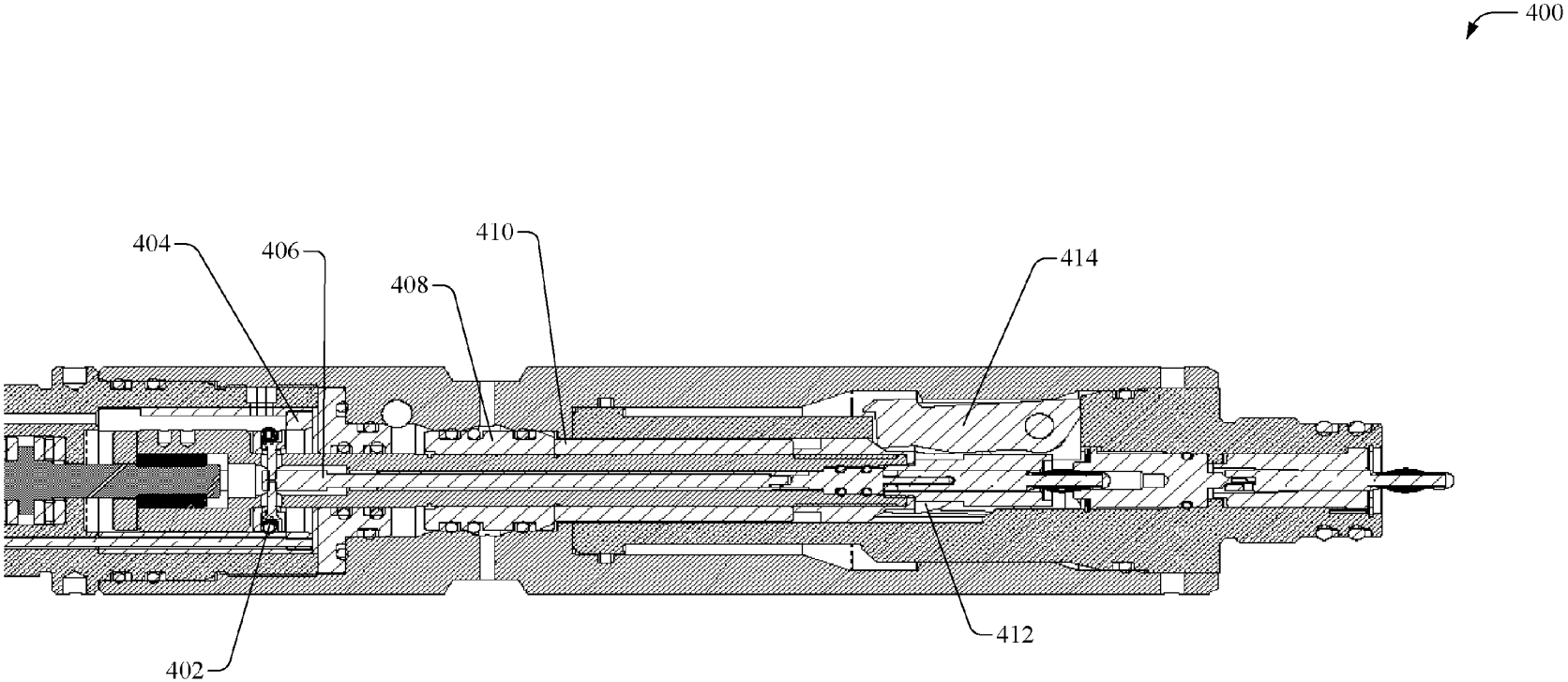
FIG. 4 depicts an enlarged view of the release mechanism drive train chamber and release chamber shown with the flooding valve beginning to open and the latching dogs partially released.

Looking now to FIG. 4, an enlarged partial view of the release mechanism 100 illustrates the reciprocating shaft 406 traveling in the disconnect direction with contact broken between the electrical spring contact 402 and the conductive ring 404. At this point power and data connectivity is no longer provided to any wireline tools connected to the fishing neck 122 assembly or any other wireline tools further down the wireline tool string. The conical dog actuator 412 is disengaging the latching dogs 414 allowing release of the fishing neck 122 assembly from the release chamber 106. The flooding valve actuating cylinder 410 is just beginning to make contact with the flooding valve 408. It should be noted that all power connections traversing the release chamber 106 are disconnected before the flooding valve 408 begins to move and allows well fluid into the release chamber 106.

Figure 5:
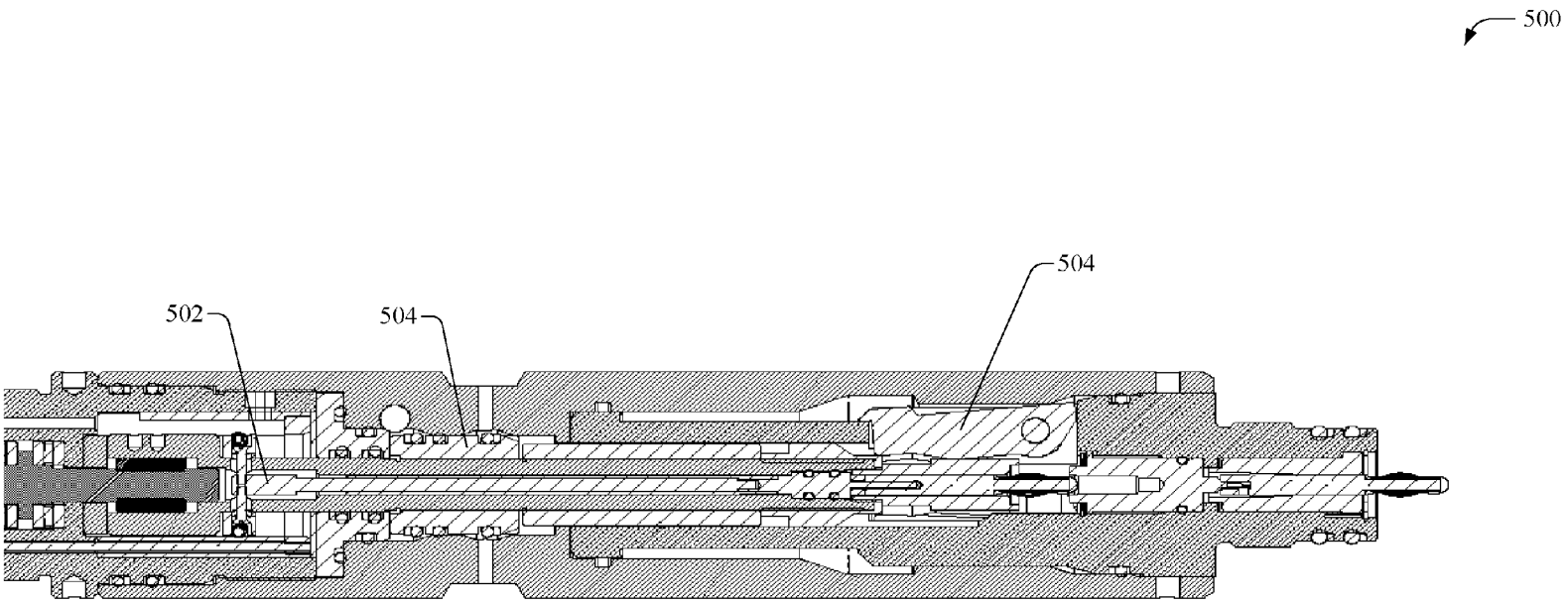
FIG. 5 depicts an enlarged view of the release mechanism drive train chamber and release chamber with the flooding valve open, the latching dogs released and the reciprocating shaft forced fully open by well fluid pressure in the release chamber.

FIG. 5 depicts an enlarged partial view of the release mechanism 100 showing a complete disconnect. The reciprocating shaft 502 has reached its maximum disconnect travel location. The flooding valve 504 is in its fully open position and latching dogs 506 are fully released. It should be noted that after releasing the fishing neck 122 subassembly the remaining wireline tools above the release mechanism 100 continue to function in their normal manner and can continue to collect data as they are removed from the well hole.

Figure 6:
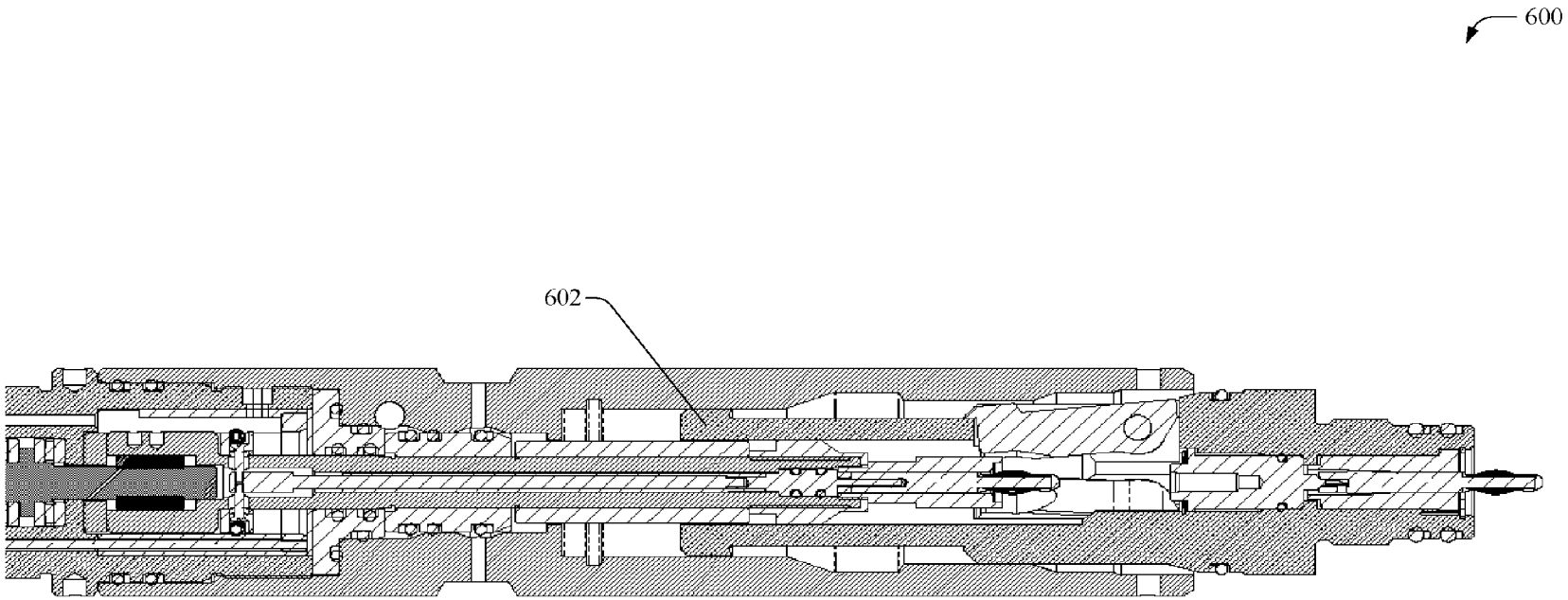
FIG. 6 depicts an enlarged view of the release mechanism drive train chamber and release chamber with the release mechanism fully released and the fishing neck disengaging.

Looking now to FIG. 6, an enlarged partial view 600 of the release mechanism 100 illustrates the disconnected release mechanism 100 being pulled from the fishing neck 602 subassembly. After retrieval of the fishing neck 602 subassembly and its attached wireline tools, the fishing neck 602 subassembly and its attached wireline tools can be reconnected to the disconnected release mechanism 100 and reinserted into the well.

Figure 7:
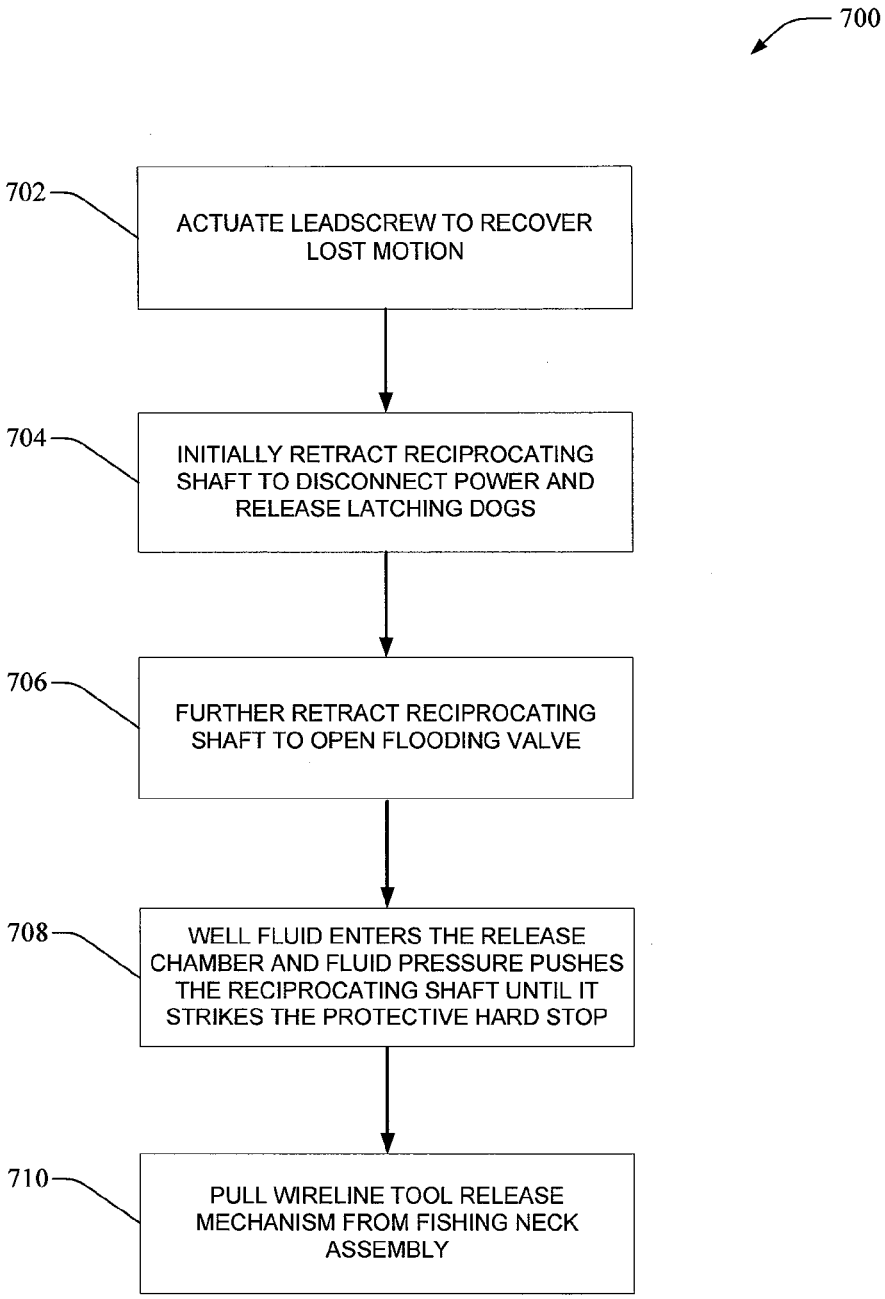
FIG. 7 depicts a method of disconnecting a fishing neck subassembly from a release mechanism.

FIG. 7 illustrates the method 700 of disconnecting the release mechanism 100 from the fishing neck 602 subassembly. Beginning at step 702, the leadscrew 110 is actuated to recover the lost motion by driving the leadscrew nut 112 to the uphole end of the drivetrain chamber 104. The leadscrew 110 can be actuated by any power transferring device such as an electric motor and gearbox assembly 102. After the leadscrew nut 112 reaches the end of its travel, the method proceeds to step 704.

At step 704, all lost motion is recovered and the reciprocating shaft 108 begins to retract towards the uphole end of the release mechanism 100. The initial reciprocating shaft 108 retraction simultaneously disconnects power and data connectivity through the release chamber 106 by separating the electrical spring contact 116 from the conductive ring 118 and disengages the latching dogs 124 by moving the conical dog actuator 130 towards the uphole end of the release mechanism 100. After the power is disconnected and the latching dogs 124 are released, the method proceeds to step 706.

Continuing at step 706, the reciprocating shaft 108 continues retracting and opens the flooding valve 120 allowing well fluid into the release chamber 106. As the high pressure well fluid enters the release chamber 106 the method proceeds to step 708 and the reciprocating shaft 108 and the flooding valve 120 are forced to the protective hard stop at the uphole end of the drivetrain chamber 104. The flooding valve 120 is now fully open and the entering well fluid has equalized the pressure on the inside and outside of the release chamber 106. Finally, at step 710, the release mechanism 100 can be pulled from the fishing neck 602 subassembly allowing removal of the remaining functional wireline tools and providing access to the fishing neck 602 subassembly for attachment of a cable suitable to pull the disconnected wireline tools from the well hole.

Figure 8:
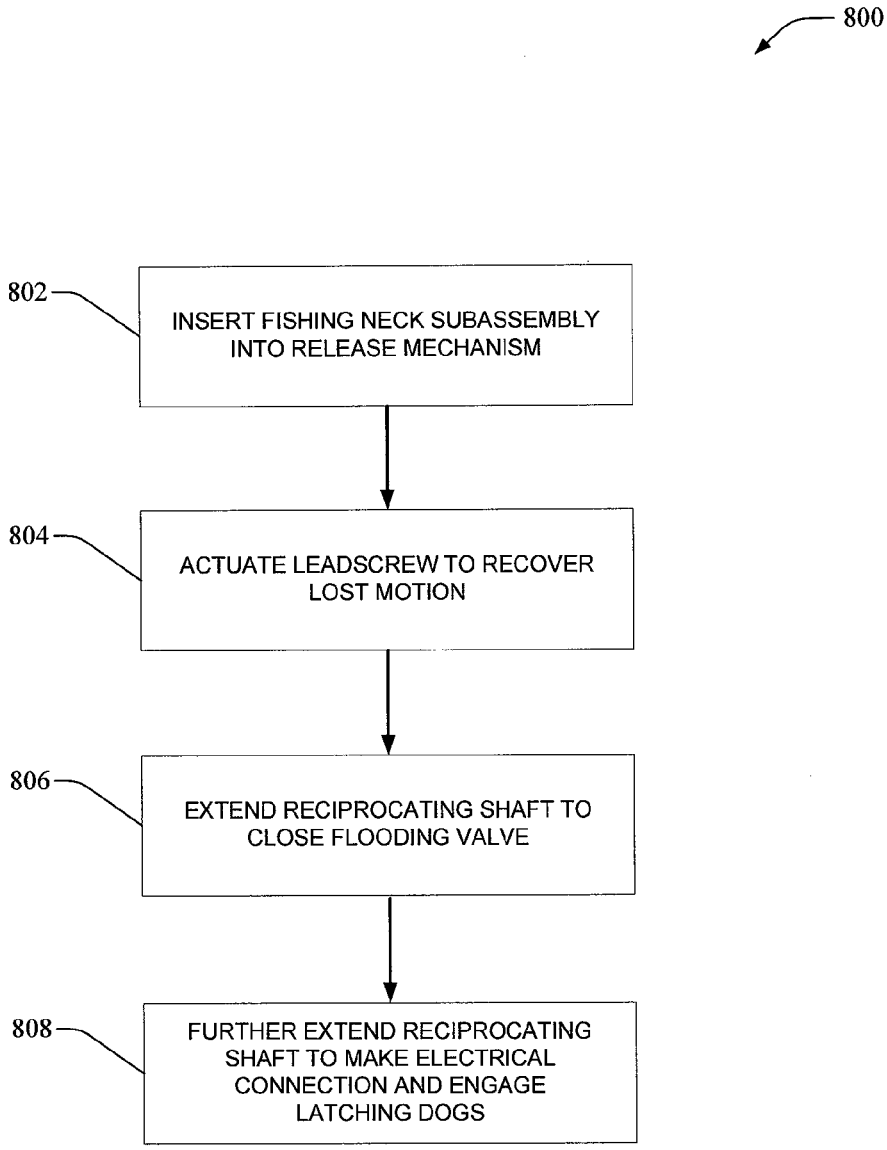
FIG. 8 depicts a method of reconnecting a fishing neck subassembly to a release mechanism.

Looking now to FIG. 8, a method of connecting a fishing neck 602 subassembly to a release mechanism 100 is illustrated. Beginning at step 802, the fishing neck 602 subassembly is inserted into the release chamber 106 until fully seated. Next, at step 804, lost motion is taken up by actuating the leadscrew 110 until the leadscrew nut 112 seats against the reciprocating shaft 108 at the uphole end of the reciprocating shaft.

Continuing to step 806, the reciprocating shaft begins extending towards the downhole end of the release mechanism 100 and drives the flooding valve to the fully closed position. Next at step 808, further extending the reciprocating shaft towards the downhole end of the release mechanism engages the latching dogs 124 into the fishing neck 602 subassembly and forces the electrical spring contact 116 against the conductive ring 118. This step results in a mechanical lockup of the fishing neck 602 subassembly and the release mechanism and provides electrical and data connectivity to the wireline tools connected to the fishing neck 602 subassembly. The wireline tool string is now prepared for insertion into the well hole.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

The invention claimed is:

1. A release mechanism system for disconnecting a plurality of wireline well tools from a wireline well tool string while maintaining operation of the plurality of wireline well tools remaining attached to the well tool string, the system comprising:

(a) a disconnection device;

(b) a multi-chambered shell comprising at least a drivetrain chamber and a release chamber;

(c) a detachable fishing neck assembly for insertion in and connection to the release chamber and connection to a wireline tool;

(d) a flooding valve for allowing well fluid into the release chamber after breaking electrical conductivity between the drivetrain chamber and the release chamber; and (e) lost motion in the disconnection device for preventing damage to elements of the disconnection mechanism as pressurized well fluid enters the release chamber.

2. The system of claim 1 wherein the disconnection device is a reciprocating shaft attached to the gearbox output and passing through the drivetrain chamber, the flooding valve, the release chamber and locking into the detachable fishing neck assembly.

3. The system of claim 2 wherein the reciprocating shaft is simultaneously attached to an electrical spring contact for disconnection from a conductive ring connected to the drivetrain chamber, attached to a conical dog actuator for disengaging a plurality of latching dogs in the release chamber and sleeved with a flooding valve actuating cylinder for opening the flooding valve.

4. The system of claim 1 wherein the drivetrain chamber has a sealed bulkhead and does not allow the entry of well fluid.

5. The system of claim 2 wherein the lost motion in the disconnection device is comprised of differing amounts of lost motion in the reciprocating shaft and in the flooding valve.

6. The system of claim 1 wherein the disconnection device is a rotating shaft attached to the gearbox output and passing through the drivetrain chamber, the flooding valve, the release chamber and locking into the detachable fishing neck assembly.

7. The system of claim 6 wherein the rotating shaft is attached to a rotating electrical spring contact for disconnection from a contact attached to the drivetrain chamber, attached to a rotating actuator for disengaging a plurality of latching dogs and attached to a rotating actuator for opening the flooding valve.

8. The system of claim 1 wherein a plurality of release mechanism systems can be connected in series and a message can be sent to the plurality of release mechanism systems instructing a specific release mechanism system to disconnect.

9. The system of claim 1 wherein an electric motor and a gearbox are attached for actuating the disconnection device.

10. The system of claim 1 wherein the fishing neck assembly attaches to the release chamber with a plurality of latching dogs.

11. The system of claim 10 wherein the plurality of latching dogs are activated by a conical latching dog actuator.

12. The system of claim 2 wherein the flooding valve is actuated by a flooding valve actuating cylinder.

13. The system of claim 12 wherein the flooding valve actuating cylinder concentrically surrounds the reciprocating shaft.

14. The system of claim 13 wherein the flooding valve actuating cylinder is loosely fit around the reciprocating shaft.

15. The system of claim 14 wherein the flooding valve actuating cylinder includes a second lost motion.

16. A method for disconnecting a fishing neck assembly from a release chamber of a wireline tool release mechanism, the method comprising:

(a) actuating a leadscrew to eliminate lost motion between a leadscrew nut and a reciprocating shaft;

(b) retracting the reciprocating shaft into a drivetrain chamber and simultaneously disconnecting electrical conductivity to the fishing neck assembly and disengaging a plurality of latching dogs;

(c) further retracting the reciprocating shaft to open a flooding valve allowing well fluid into the release chamber;

(d) protecting the drivetrain from well fluid pressure force by driving the reciprocating shaft into a hard stop; and (e) pulling the wireline tool release mechanism away from the disconnected fishing neck.

17. The method of claim 16, further comprising disconnecting only when a received disconnect command address matches the wireline tool release mechanism address.

18. The method of claim 16, further comprising testing the disconnecting method and device by reconnecting the fishing neck assembly to the release chamber, the method comprising:

(a) manually inserting the fishing neck assembly into the release chamber until it is seated around a reciprocating shaft;

(b) actuating a leadscrew to recover lost motion between a leadscrew nut and the reciprocating shaft;

(c) extending the reciprocating shaft until it locks against a flooding valve and forces the flooding valve into a closed position; and (d) further extending the reciprocating shaft until it simultaneously makes an electrical connection between an electrical spring contact and a conductive ring and engages a plurality of latching dogs and engages hard stops.

19. A system for disconnecting wireline well tools without loss of functionality of any remaining connected wireline well tools, the system comprising:

(a) means for actuating a disconnection device;

(b) means for separating a multi-chambered shell comprising at least a drivetrain chamber and a release chamber;

(c) means for inserting and connecting a detachable fishing neck assembly into the release chamber;

(d) means for allowing well fluid into the release chamber after breaking electrical conductivity between the drivetrain chamber and the release chamber; and (e) means for allowing lost motion in the disconnection device for preventing damage to elements of the disconnection mechanism as pressurized well fluid enters the release chamber.

20. The system of claim 19 further comprising means for addressing and instructing one of a series of wireline well tools to disconnect.

* * * * *